US005573175A

United States Patent [19]

Straub et al.

[11] Patent Number: 5,573,175

[45] Date of Patent: Nov. 12, 1996

[54] OCTAGONAL CONTAINER WITH LOCK BOTTOM

[75] Inventors: Gustave O. Straub, Milwaukee; Jeffrey D. Schneider, Menomonee Falls, both of Wis.

[73] Assignee: Jefferson Smurfit Corporation, Clayton, Mo.

[21] Appl. No.: 361,161

[22] Filed: Dec. 21, 1994

Related U.S. Application Data

[63] Continuation of Ser. No. 200,004, Feb. 22, 1994, abandoned.

[51] Int. Cl.[6] ..... B65D 5/06

[52] U.S. Cl. ..... 229/109; 229/119; 229/185; 220/DIG. 6

[58] Field of Search ..... 229/185, 109, 229/157, 183, 119, 120, 916; 220/DIG. 6, 517

[56] References Cited

U.S. PATENT DOCUMENTS

| | | | |
|---|---|---|---|
| 3,302,853 | 2/1967 | Locke | 229/157 |
| 3,366,496 | 1/1968 | Bomar et al. | 229/119 X |
| 3,539,090 | 11/1970 | Blasdell | 229/185 X |
| 4,184,625 | 1/1980 | Stollberg et al. | 220/DIG. 6 X |
| 4,371,366 | 2/1983 | Bower et al. | 229/916 X |
| 4,441,649 | 4/1984 | Nederveld | 229/185 X |
| 4,702,408 | 10/1987 | Powlenko | 229/109 X |
| 4,709,852 | 12/1987 | Stoll | 229/185 X |
| 4,899,927 | 2/1990 | Straub et al. | 229/109 |
| 5,390,847 | 2/1995 | Young | 229/916 X |

*Primary Examiner*—Stephen J. Castellano
*Assistant Examiner*—Christopher J. McDonald
*Attorney, Agent, or Firm*—Richard W. Carpenter

[57] ABSTRACT

A one-piece, octagonal, bulk shipping container with a lock bottom arrangement that includes interlocking inner and outer bottom closure flaps wherein the inner closure flaps have lock tabs that extend downwardly through openings in the outer closure flaps to lock the flaps together and also which extend under lock tongues of the outer closure flaps to function as a cushion for the contents of the container.

2 Claims, 2 Drawing Sheets

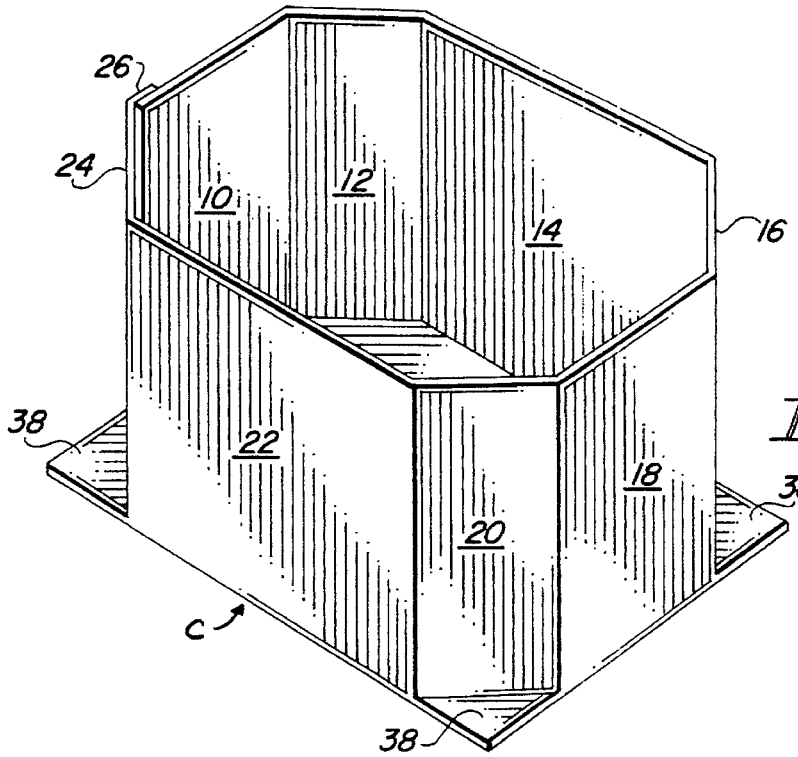
FIG. 1
FIG. 2
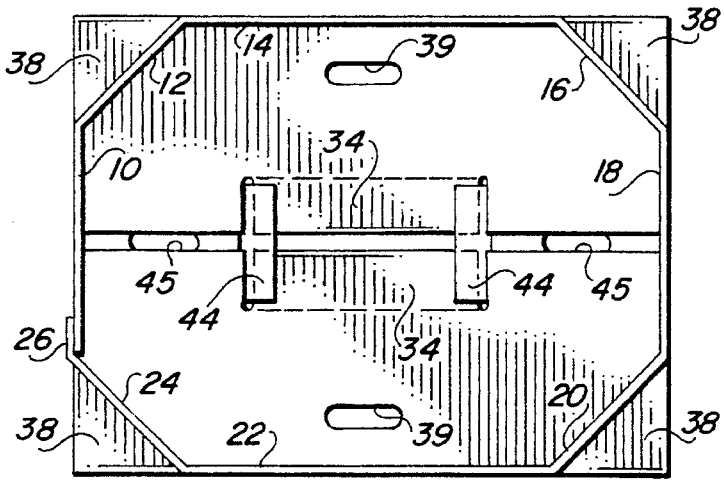
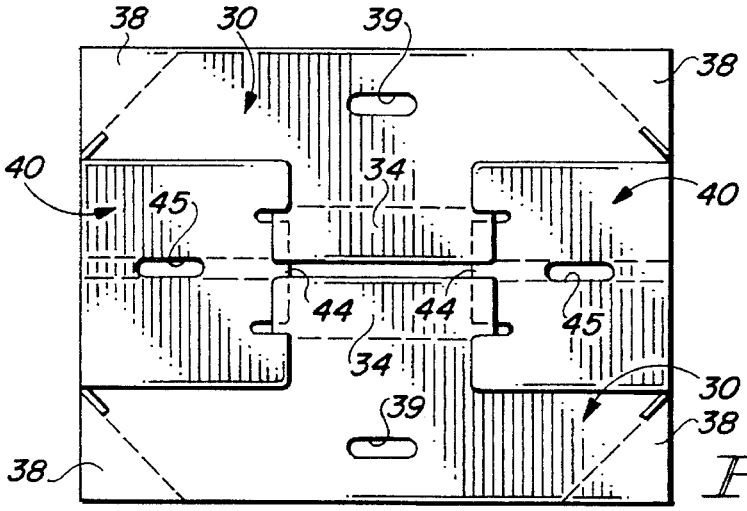
FIG. 3

OCTAGONAL CONTAINER WITH LOCK BOTTOM

This is a continuation of application Ser. No. 08/200,004 filed on Feb. 22, 1994, now abandoned.

BACKGROUND OF THE INVENTION

1. Field of the Invention

This invention relates to collapsible, paperboard shipping containers, and more particularly to octagonal containers of the type used for the bulk shipment of apples and other types of produce. The invention represents an improvement over the invention disclosed and claimed in Applicants' earlier U.S. Pat. No. 4,899,927.

2. Description of the Background Art

A background art search directed to the subject matter of this invention conducted in the United States Patent and Trademark Office disclosed the following U.S. Pat. Nos.: 2,565,188 4,119,266 4,148,427 4,260,100 4,343,429 4,441,649 4,382,537 4,386,729 4,392,607 4,441,649 4,502,624 4,511,080 4,582,198 4,702,408 4,899,927 4,953,782.

None of the patents uncovered in the search discloses a collapsible, octagonal, paperboard, bulk shipping container with a lock bottom closure arrangement wherein portions of the locking structure fold to the outside to prevent bruising of the packaged products and also to cushion the packaged products.

SUMMARY OF THE INVENTION

It is a primary object of the invention to provide a paperboard bulk shipping container with an improved lock bottom arrangement that prevents the contents of the container from being bruised and that also serves to cushion the container contents.

A more specific object of the invention is the provision of a one piece, octagonal, bulk shipping container with a lock bottom arrangement that includes interlocking inner and outer bottom closure flaps wherein the inner closure flaps have lock tabs that extend downwardly through the outer closure flaps to lock the flaps together and also which extend under portions of the outer closure flaps to function as a cushion for the contents of the container.

These and other objects of the invention will be apparent from an examination of the following description and drawings.

BRIEF DESCRIPTION OF THE DRAWINGS

FIG. 1 is a fragmentary isometric view of a bulk shipping container embodying features of the present invention;

FIGS. 2 and 3 are top and bottom plan views, respectively, of the structure illustrated in FIG. 1;

It will be understood that, for purposes of clarity, certain elements may have been omitted from certain views where they are believed to be illustrated to better advantage in other views.

DESCRIPTION OF THE PREFERRED EMBODIMENT

Figure 4:
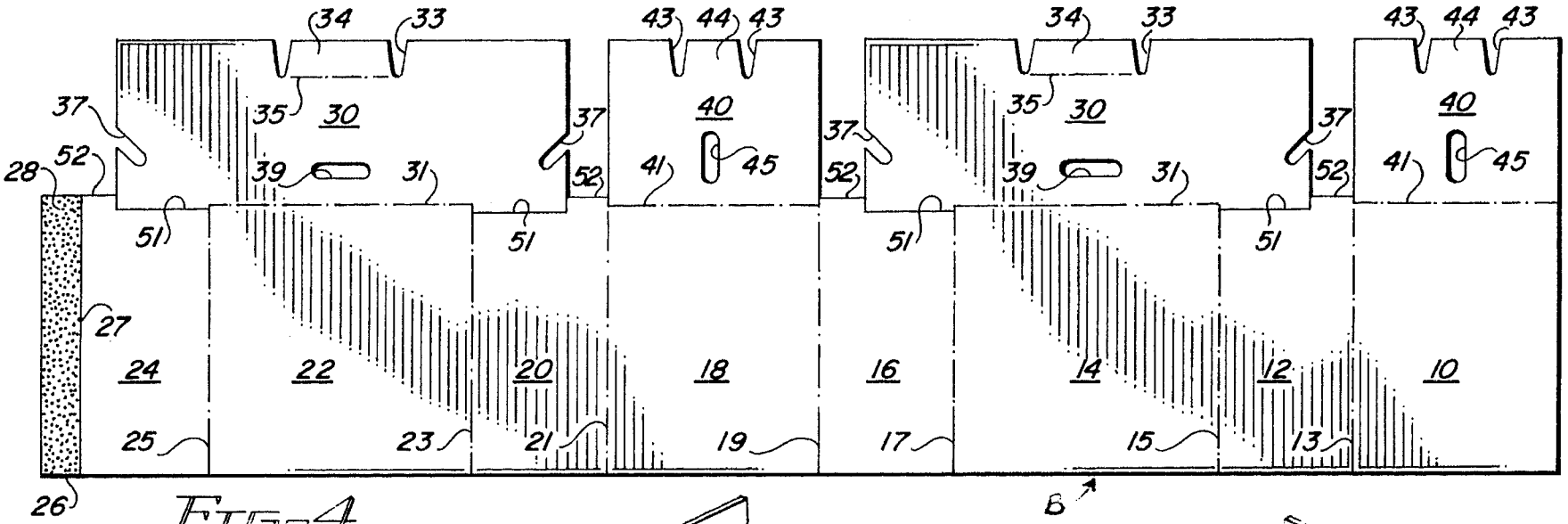
FIG. 4 is a plan view of the blank of foldable sheet material from which the container illustrated in the other views may be formed.

Referring now to the drawings for a better understanding of the invention, it will be seen that the present invention includes a one piece, collapsible, paperboard, octagonal, bulk shipping container, indicated generally at C in FIG. 1, which can be formed from a unitary blank of foldable paperboard, indicated generally at B in FIG. 4.

As best seen in FIGS. 1 and 4, the body of container C includes 1st minor side wall panel 10, 1st corner side wall panel 12, 1st major side wall panel 14, 2nd corner side wall panel 16, 2nd minor side wall panel 18, 3rd corner side wall panel 20, 2nd major side wall panel 22, 4th corner side wall panel 24, and glue panel 26 which are foldably joined to each other along parallel fold lines 13, 15, 17, 19, 21, 23, 25, and 27, respectively.

Figure 5:
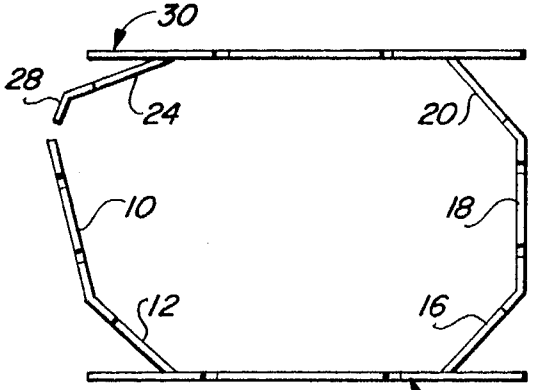
FIG. 5 is a fragmentary bottom plan view illustrating the first step in erecting the container illustrated in FIG. 1 from the blank illustrated in FIG. 4.

Adhesive is applied to glue panel 26, as indicated at 28, and the glue panel is secured to a marginal side portion of 1st minor side wall panel 10, as shown in FIGS. 1 and 5, to form a tubular structure open at the upper and lower ends.

The upper end of the structure may be closed by a cover or cap of any desired configuration. No cap or cover is illustrated or described herein, as the upper closure is not a feature of the present invention.

The essential feature of the invention resides in the bottom wall lock closure arrangement,. which is best illustrated in FIGS. 2, 3, 4, 6, and 7 of the drawings.

The bottom closure arrangement comprises pairs of inner closure flaps 30 and outer closure flaps 40 that are folded into overlapping interlocking relation that provides an improved bottom wall structure. Inner closure flaps 30 are foldably joined, along fold lines 31, to lower edges of major side wall panels 14 and 22.

Each inner closure flap 30 has, extending inwardly from its free edge, a pair of laterally spaced recesses 33 between which is located a lock tab 34 that is cut from material of the inner closure flap and hingedly attached to the remainder of the inner closure flap along a fold line 35.

As best seen in FIG. 4, each inner closure flap is wider than the major side wall panel to which it is attached, so that side portions of the inner closure flap are actually formed from material cut from end portions of adjacent corner side wall panels.

Where the material is cut from the corner side wall panels, there are formed in the corner side wall panels recesses 51 and adjacent projecting portions 52, each of which has a definite function that is described later herein.

Each of the inner closure flaps 30 is also provided with slots 37 that slant inwardly at acute angles from the opposite side edges thereof toward the lower corners of the major side wall panel to which the inner closure flap is joined. The purpose of the slots 37 is also described later herein.

Additionally, each inner closure flap is provided with at least one vent hole 39 extending therethrough and which is located adjacent fold line 31 and the related major side wall panel.

Outer closure flaps 40 are foldably joined, along fold lines 41, to the lower edges of minor side wall panels 10 and 18.

Each outer closure flap 40 has, extending inwardly from its free edge, a pair of laterally spaced recesses 43 between which is located a rigid tongue 44 that is formed from material of the outer closure flap.

Additionally, each outer closure flap 40 has extending therethrough a vent opening 45.

The tubular structure of the container C is formed at the container manufacturer, where the glue panel 26 is attached to the minor side wall panel 10 at the remote end of blank B. The containers can then be shipped in collapsed condition to the packers where they can be erected easily and quickly by hand when ready for use.

Figure 7:
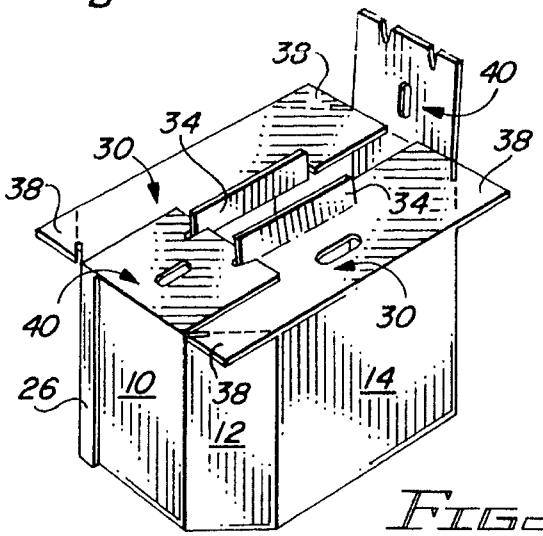
FIGS. 6 and 7 are fragmentary isometric views, as seen from the bottom, illustrating further steps in the erection of the container.
Figure 6:
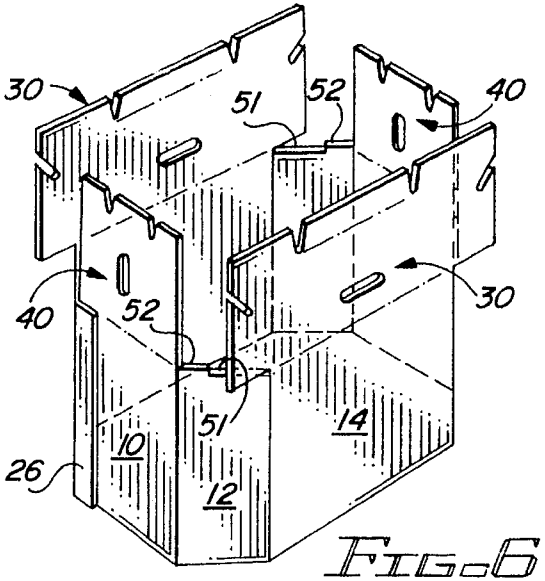

The first step in erecting the container is to open the body to the position shown in FIGS. 6 and 7 and fold the inner closure flaps 30 inwardly 90 degrees until they are co-planer, with the lock tabs 34 being folded outwardly 90 degrees as best seen in FIG. 7.

As the inner flaps 30 are folded inwardly, edge portions of the inner flaps are positioned within recesses 51 in the end edges of adjacent corner side wall panels and with the projections 52 of the corner side wall panels being positioned within the related slots 37 in the side edges of the bottom wall inner closure flaps.

The bottom wall outer closure flaps can then be folded 90 degrees inwardly to overlie adjacent portions of the inner closure flaps, and with the outer closure flap tongues 44 positioned between the inner closure flap lock tabs and the lock tabs extending through the related slots 43 in the outer closure flaps.

The inner closure flap lock tabs can then be folded inwardly 90 degrees toward each other, as shown in FIGS. 3 and 4, to interlock the inner and outer closure flaps with each other. The thickness of the outer closure flaps prevents the inner closure flap lock tabs from lying completely flat, so a spring effect is created that serves to provide a slight cushion for the bottom of the container.

It should be noted that the bottom wall outer closure flap vent openings 45 are so positioned as to lie between the adjacent inner edges of the bottom wall inner closure flaps when the container is in the erected condition.

Also, as best seen in FIG. 1, the corner portions 38 of the bottom wall inner flaps extend beyond the corner side walls of the container. These portions can be readily secured to the upper surface of a pallet (not shown) for convenience in shipping and handling.

Thus, the invention provides an improved bulk container with a smooth inner bottom wall surface to prevent bruising of the contents of the container, and the container bottom closure flap arrangement affords some degree of cushioning for the container contents.

What is claimed is:

1. A one-piece, collapsible, octagonal, bulk, shipping container formed from a unitary blank of foldable sheet material, such as paperboard, comprising:

(a) pairs of opposed major side wall panels, minor side wall panels, corner side wall panels, and an attaching panel foldably joined to each other, along parallel vertical fold lines, to form a tubular structure open at the ends;

(b) said major side wall panels extending parallel to each other and normal to said minor side wall panels, and said corner side wall panels extending diagonally between adjacent of said major and minor side wall panels;

(c) inner closure flaps foldably joined to lower edges of said major side wall panels and folded inboardly toward each other;

(d) said inner closure flaps each having a width greater than that of the major side wall panel to which it is joined and having side portions which underlie and are partly formed from material cut from adjacent of said corner side wall panels;

(e) said inner closure flaps also having, in opposed side edges thereof, diagonal slots receiving lower portions of adjacent of said corner side wall panels;

(f) a pair of outer closure flaps foldably joined to lower edges of said minor closure panels and folded inboardly therefrom, and normal thereto toward each other, and underlying portions of said inner closure flaps;

(g) said outer closure flaps each having a pair of laterally spaced openings extending inwardly from a free edge thereof that define therebetween a lock tongue formed from material of a portion of said outer closure flap and extending from a remaining portion of said inner closure flap;

(h) said lock tongue being foldably joined to said outer closure flap remaining portion along a fold line extending between said laterally spaced openings and parallel to a fold line joining said outer closure flap to a related of said side wall panels;

(i) said inner closure flaps each having a pair of laterally spaced openings extending inwardly from a free edge thereof that define therebetween a lock tab formed from material cut from a portion of said inner closure flap and foldably joined to and extending rigidly from a remaining portion of said inner closure flap;

(j) said inner closure flap lock tabs being positioned to extend downwardly through related of said outer closure flap openings and underlying said outer closure flap lock tongues;

(h) said outer closure flap lock tongues being arranged and disposed to prevent said inner closure flap lock tabs from lying completely flat against the underside of said outer closure flaps, whereby a positive cushioning effect is achieved by said inner closure flap lock tabs;

(l) each of said inner closure flaps including portions overlying portions of said outer closure flaps and having inboard edges spaced laterally from each to define an opening therebetween; and (m) each of said outer closure flap portions having extending therethrough a centrally disposed, elongated, vent hole extending in a direction normal to a fold line joining said inner closure flap to a related of said side wall panels, so that when said container is erected said vent hole will be positioned between the inboard edges of said overlying outer closure flaps portions in alignment with the opening between said inboard edges.

2. A container according to claim 1, wherein the combined lengths of said inner closure flaps is less than the distance between said major side wall panels to which said inner closure flaps are attached, whereby said inner closure flap inboard edges are spaced from each other to provide said opening therebetween.

* * * * *